US010384475B2

(12) United States Patent
De Roeck et al.

(10) Patent No.: US 10,384,475 B2
(45) Date of Patent: Aug. 20, 2019

(54) INKJET PRINTING DEVICE FOR RIGID MULTILAYERED SUBSTRATES

(71) Applicant: AGFA NV, Mortsel (BE)

(72) Inventors: Luc De Roeck, Mortsel (BE); Jurgen Van Dorpe, Mortsel (BE)

(73) Assignee: AGFA NV, Mortsel (BE)

( * ) Notice: Subject to any disclaimer, the term of this patent is extended or adjusted under 35 U.S.C. 154(b) by 0 days.

(21) Appl. No.: 15/772,099

(22) PCT Filed: Oct. 28, 2016

(86) PCT No.: PCT/EP2016/076036
§ 371 (c)(1),
(2) Date: Apr. 30, 2018

(87) PCT Pub. No.: WO2017/076762
PCT Pub. Date: May 11, 2017

(65) Prior Publication Data

US 2018/0345686 A1 Dec. 6, 2018

(30) Foreign Application Priority Data

Nov. 3, 2015 (EP) ..... 15192683

(51) Int. Cl.
*B41J 11/00* (2006.01)
*B41J 3/407* (2006.01)

(52) U.S. Cl.
CPC ..... *B41J 11/0045* (2013.01); *B41J 3/407* (2013.01); *B41J 11/001* (2013.01); *B41J 11/002* (2013.01)

(58) Field of Classification Search
CPC ..... B41J 11/0045; B41J 3/407; B41J 11/001; B41J 11/002
See application file for complete search history.

(56) References Cited

U.S. PATENT DOCUMENTS 5,757,407 A 5/1998 Rezanka
2009/0284575 A1* 11/2009 Verhoest ..... B41J 11/001 347/104

FOREIGN PATENT DOCUMENTS

CN 104228341 A 12/2014

OTHER PUBLICATIONS

IP.com search (Year: 2019).*
Official Communication issued in International Patent Application No. PCT/EP2016/076036, dated Feb. 8, 2017.

* cited by examiner

*Primary Examiner* — Lisa Solomon
(74) *Attorney, Agent, or Firm* — Keating and Bennett, LLP

(57) ABSTRACT

An inkjet printing device includes a transport system for transporting a rigid multilayered substrate in a print direction and a support plane; a dryer, attached to a first gantry which is positioned over the transport system and perpendicular to the print direction, for immobilizing a jetted ink layer in a drying zone; and a push down mechanism for the rigid multilayered substrate against the transport system, arranged at least in the drying zone. The push down mechanism includes a bar which is positioned parallel and elongated to the print direction and mounted parallel to the support plane above the transport system. The bar is maintained on a second and third gantry by a maintainer on each gantry and positioned over the transport system at each side of the first gantry and perpendicular to the print direction. The push down mechanism includes a bender for pushing a portion from the bar at the push down side with an angle towards the transport system in a plane, perpendicular to the support plane and parallel to the print direction.

15 Claims, 6 Drawing Sheets

INKJET PRINTING DEVICE FOR RIGID MULTILAYERED SUBSTRATES

CROSS REFERENCE TO RELATED APPLICATIONS

This application is a 371 National Stage Application of PCT/EP2016/076036, filed Oct. 28, 2016. This application claims the benefit of European Application No. 15192683.9, filed Nov. 3, 2015, which is incorporated by reference herein in its entirety.

BACKGROUND OF THE INVENTION

1. Field of the Invention

The present invention relates to an inkjet printing device, especially a vacuum belt inkjet printing device, for supporting rigid multilayered substrates, such as corrugated fibreboards or corrugated plastics.

2. Description of the Related Art

The availability of better performing print heads, such as less drop-outs and failing nozzles, and the lower cost of print heads, the maximum printing size of inkjet printing devices is enlarged to print on large rigid substrates such as wood panels or large cardboards. To support these large substrates, a large transport system has to be manufactured.

The large rigid substrates are in the state-of-the art supported on vacuum transport systems and/or guided on transport systems so the colour registry on these large rigid substrates is guaranteed to have an optimal print quality.

Inkjet printing devices with a vacuum belt, as transport system for large rigid substrates, for transporting these substrates underneath a print head are known. Such inkjet printing devices were adapted for sign & display market with small sized substrates to much larger substrates for industrial market; and special substrates such as manufacturing methods for glass, laminate floorings, carpets, textiles. An example of such inkjet printing device is the 2.5 meter wide hybrid 6-color inkjet printer Agfa Graphics™: Jeti Tauro™. This printer may accommodate rigid substrates up to 4.0 meters in length.

Due to the tensions inside a rigid multilayered substrate, in and between the plurality of layers, heating up the rigid multilayered substrate, while drying a jetted ink layer, the existing tensions inside the rigid multilayered substrate, especially large rigid multilayered substrate, may be disturbed which cause sudden warping up of the rigid multilayered substrate so the rigidness is lost. The rigidness of these substrates is accomplished by the use of the plurality of layers in these substrates. This sudden warping up may damage the costly dryer of the inkjet printing device. The distance between the dryer in the inkjet printing device and the substrate is mostly of the time less than 1 cm for example to avoid that radiation of the dryer dries ink on the print head or radiations of the dryer reaches the operator of the inkjet printing device. The sudden warping up of the rigid multilayered substrate is rapidly too high so a collision is inevitable.

Especially when the rigid multilayered substrates are large a part of the substrate has the room temperature wherein the inkjet printing device is installed, another part of the substrate is heated up by the dryer and another part of the substrate is cooling back to the room temperature after heated up by the dryer. These three conditions disturb the inside tensions of the rigid multilayered substrate which causes sudden curving of these substrates which are unpredictable happening and to fast to handle easily.

Also the differences in moisture in the different layers from the rigid multilayered substrate may cause sudden warping up of the rigid multilayered substrate while heating-up the substrate when drying the wet ink layers on the print side from this rigid multilayered substrate. Especially when the rigid multilayered substrate comprises expandable fibres by moisturizing as in corrugated fibreboards.

The sudden warping up from these rigid multilayered substrates in the drying zone is in the state-of-the-art inkjet printing devices difficult to handle and cause several times damages to the dryer which generates the drying zone and/or changes the height settings of the dryer above the transport system. The length of the drying zone, which is measured parallel to the printing direction, becomes larger and larger in the conversion of the inkjet printing devices to industrial inkjet printing devices, so a guide and pushing down mechanism for substrates in the drying zone becomes more and more difficult to added and/or calibrated and which is strong enough to keep the rigid multilayered down on sudden warping up.

The state-of-the-art inkjet printing devices with a vacuum transport system may not cover this issue because the vacuum power to hold down the rigid multilayered substrates is too weak for this sudden warping up. Installing a stronger vacuum chamber with enlarged vacuum power is a possible solution but it doesn't guarantee the holding down of these rigid multilayered substrates because the inside tensions of these substrates, especially large substrates is too high. The sudden warping up is also unpredictable because it depends on the kind of the rigid multilayered substrate; and/or conditions of the rigid multilayered substrate, such as moisture inside the layers; and/or production parameters of the rigid multilayered substrate.

The calibration of the height settings for the dryer above the transport system in an inkjet printing device is very important because it influences the print quality on the substrates by controlling the wetting size of the jetted droplets and the coalescences of jetted droplets. Uniformity of drying is also part of this height setting calibration.

Also the calibration of the height settings for the dryer above the transport system in an inkjet printing device is very important because it influences the dryness of the jetted ink layers which may causes offset of ink to the backside of substrates when stapled on each other after printing if not dried enough.

Pre-heating the back-side from the substrate is also a state-of-the-at inkjet printing method, especially for corrugated fibreboards to pre-conditioning, such as controlling the moisture in the layers, the substrate prior drying the jetted ink layers on the substrate. But it is found that the adjustment of such pre-conditioning means are hard to become a bullet proof solution against collision against the dryer because the sudden warping up is also unpredictable because it depends on the kind of the rigid multilayered substrate; and/or conditions of the rigid multilayered substrate, such as moisture inside the layers; and/or production parameters of the rigid multilayered substrate. This state-of-the-art inkjet printing method is also only a weak solution for corrugated fibreboards and not for all kind of rigid multilayered substrates such as corrugated plastics. It solves only the moisture housekeeping of the corrugated fibreboards before printing.

Therefore there is a need of an inkjet printing device that bullet proof avoids collisions against the dryer, especially for rigid multilayered substrates wherein the heating up of the multilayered substrates, when drying jetted ink layers, causes warping up of the rigid multilayered substrates due to the inside tensions of its layers and tensions between its layers.

SUMMARY OF THE INVENTION

In order to overcome the problems described above, preferred embodiments of the present invention have been realised with an inkjet printing device and an inkjet printing method as defined below.

The inkjet printing device (300) and inkjet printing method from the present invention guarantees a bullet proof avoidance of a collision from a rigid multilayered substrate (500) against the dryer (315) when the rigid multilayered substrate (500) is warped up due to the heating-up of the multilayered substrate when drying a jetted ink layer. The invention is related to the dryer (315) of inkjet printing device (300) which generates radiation, such as heat, on the substrate whereby a sudden warping up or sudden curling of the rigid multilayered substrate (500) may occur.

The heat of print heads in the inkjet printing device (300) is negligible for the sudden warping up of the rigid multilayered substrate (500).

DETAILED DESCRIPTION OF THE PREFERRED EMBODIMENTS

Figure 1:
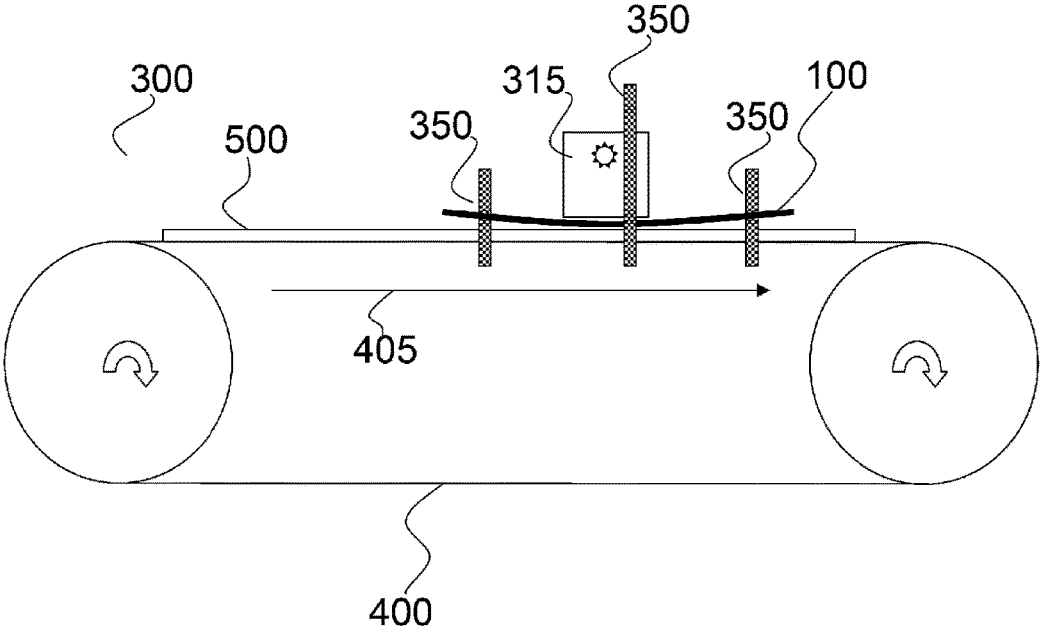
FIG. 1 illustrates a cross-section of an inkjet printing device (300), which is not fully visible; according to one of the preferred embodiments of the present invention. The illustrated inkjet printing device (300) comprises a transport system (400) which transports on a conveyor belt and in a print direction (405) a rigid multilayered substrate (500) underneath a dryer (315). The print head of the inkjet printing device (300) is not visible. The dryer (315) is attached on a gantry (350) and before and after this gantry two other gantries are attached to the inkjet printing device (300) which both hold a flat bar (100) under tension so the flat bar (100) is bended. The bending of the flat bar (100) in this figure is exaggerated for illustrative purposes.
Figure 2:
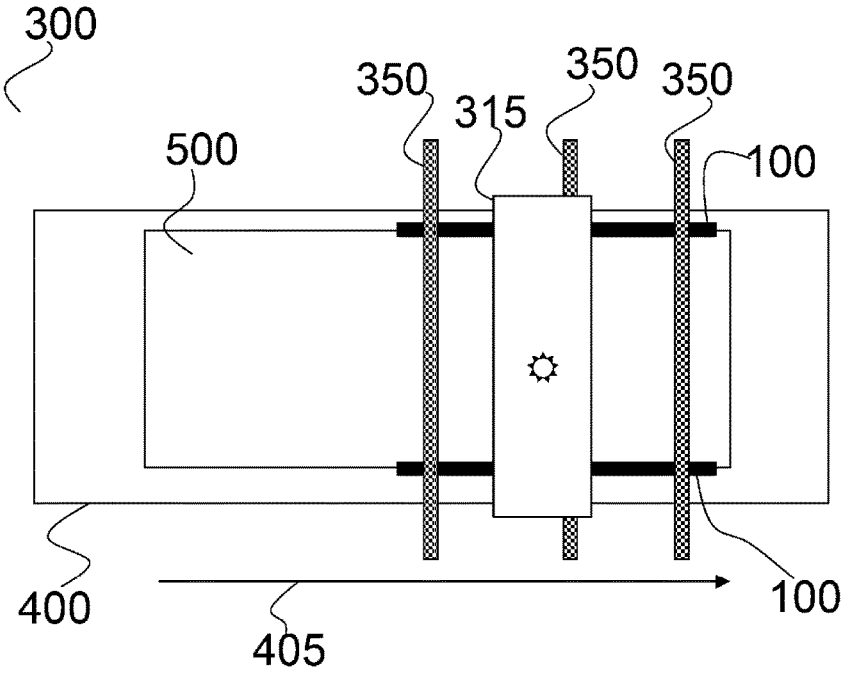
FIG. 2 illustrates a top view of an inkjet printing device (300), which is not fully visible; according to one of the preferred embodiments of the present invention. The rigid multilayered substrate (500) is pushed down in the drying zone at its edges, parallel to the print direction (405), at each side with flat bars (100) which are attached to two gantries (350). The inkjet printing device (300) comprises a dryer (315) attached to a gantry (350) for creating a drying zone on the rigid multilayered substrate (500). The rigid multilayered substrate (500) is supported and transported by a transport system (400). The print head of the inkjet printing device (300) is not visible.
Figure 3:
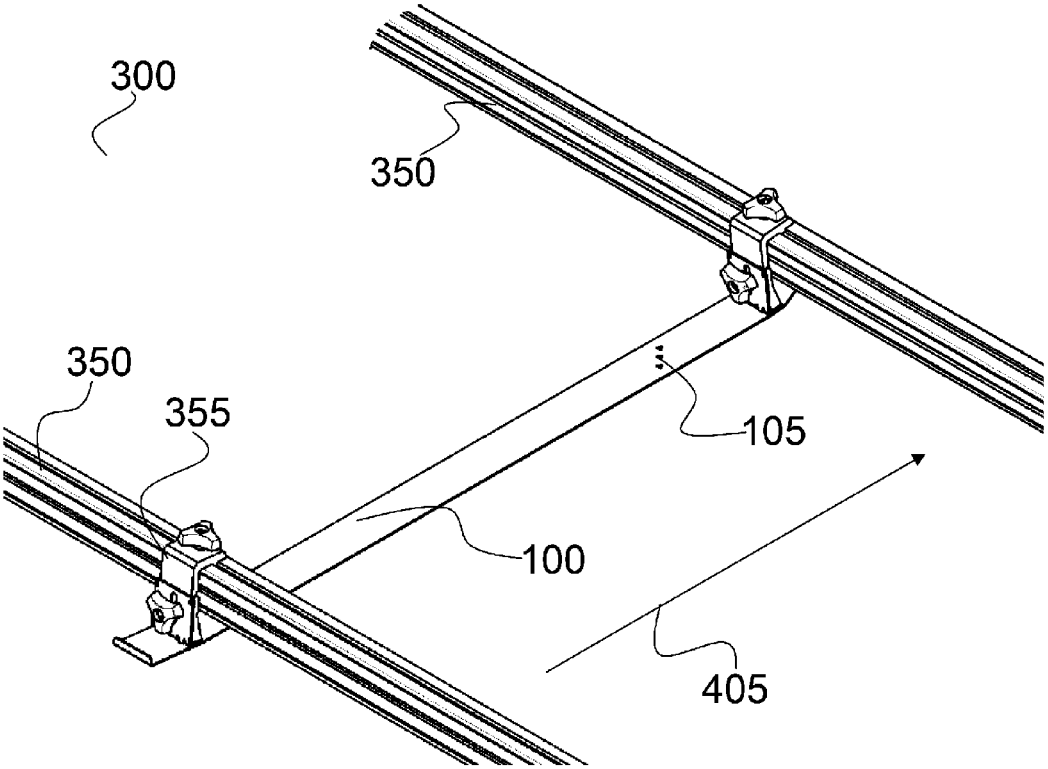
FIG. 3 illustrates a closer view of a flat bar (100) in a preferred inkjet printing of the present invention which is attached by the two gantries (350) with maintainers (355). The arrow in FIG. 3 is the print direction. The flat bar (100) comprises also three holes for easy alignment of rigid multilayered substrate (500). The two gantries (350) are angled towards the support surface for bending the flat bar (100) by angling a flat portion of the flat bar (100). For visual alignment of a rigid multilayered substrate underneath the flat bar (100) a set of alignment holes (105) are added in the flat bar (100). The rotating knobs, also called lock bolts, in FIG. 3 lock easily and fixed the flat bar (100) to the gantry (350) so fast height calibration and positioning of the flat bar (100) is possible.
Figure 4:
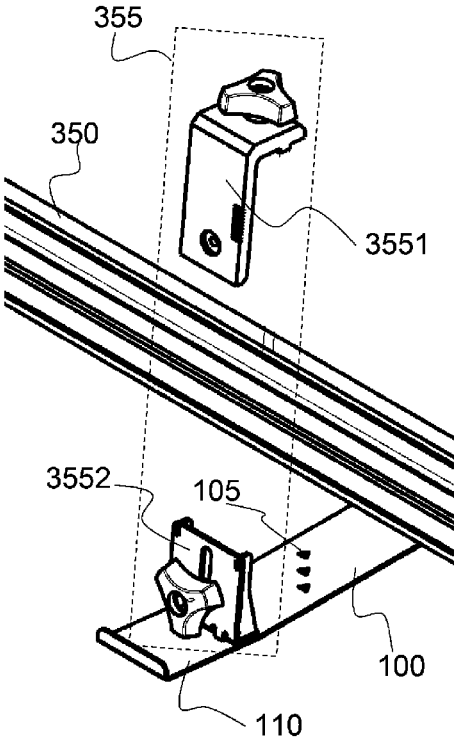
FIG. 4 illustrates a demounted maintainer (355) of the previous illustration with two attachable means (3551, 3552).
Figure 5:
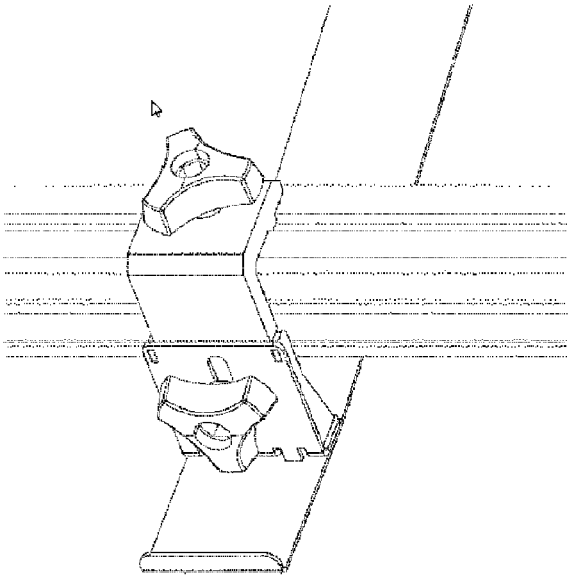
FIG. 5 illustrates a closer view of a mounted maintainer (355). The first attachable means (3551) is for positioning along the gantry (350) the flat bar (100) and the second attachable means (3552) is for positioning the height of the flat bar (100). For visual alignment of a rigid multilayered substrate underneath the flat bar (100) a set of alignment holes (105) are added in the flat bar (100).
Figure 6:
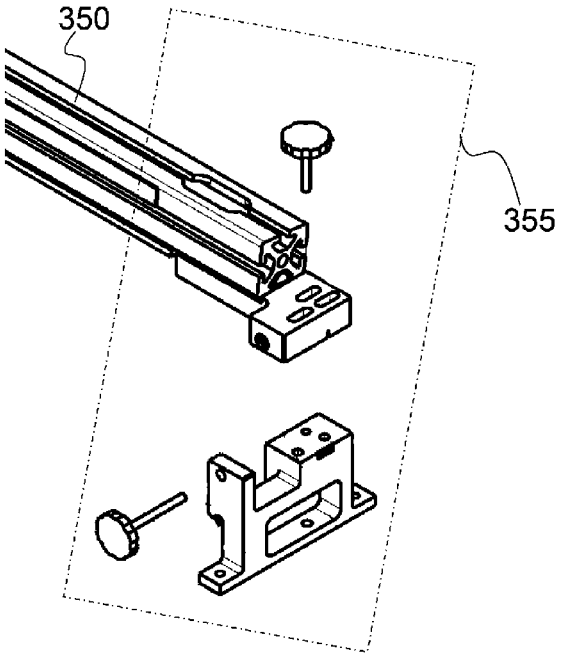
FIG. 6 illustrates demounted position controlling means of the gantry (350) to the inkjet printing device (300), as illustrated in FIG. 3, FIG. 4 and FIG. 5, wherein the upper rotary knob, also called lock bolt, is for locking the position of the gantry (350) fixed and the other rotary knob, also called the tension knob, is for displacement of the gantry (350) parallel to the print direction. By the displacement parallel to the print direction and the angled gantry the tension of the flat bar (100) is controlled and the pushing down in the drying zone is controlled to push down by mechanical pressure the rigid multilayered substrate (500) if suddenly the substrate curls.
Figure 7:
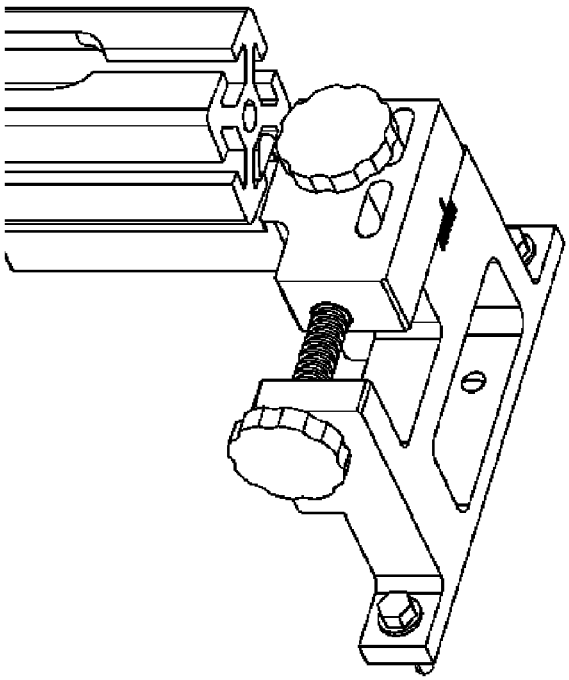
FIG. 7 illustrates the mounted position controlling means as illustrated in FIG. 6. The rotating knobs lock easily and fixed the gantry (350) to the inkjet printing device (300) so fast height calibration and positioning of the gantry (350) is possible.
Figure 8:
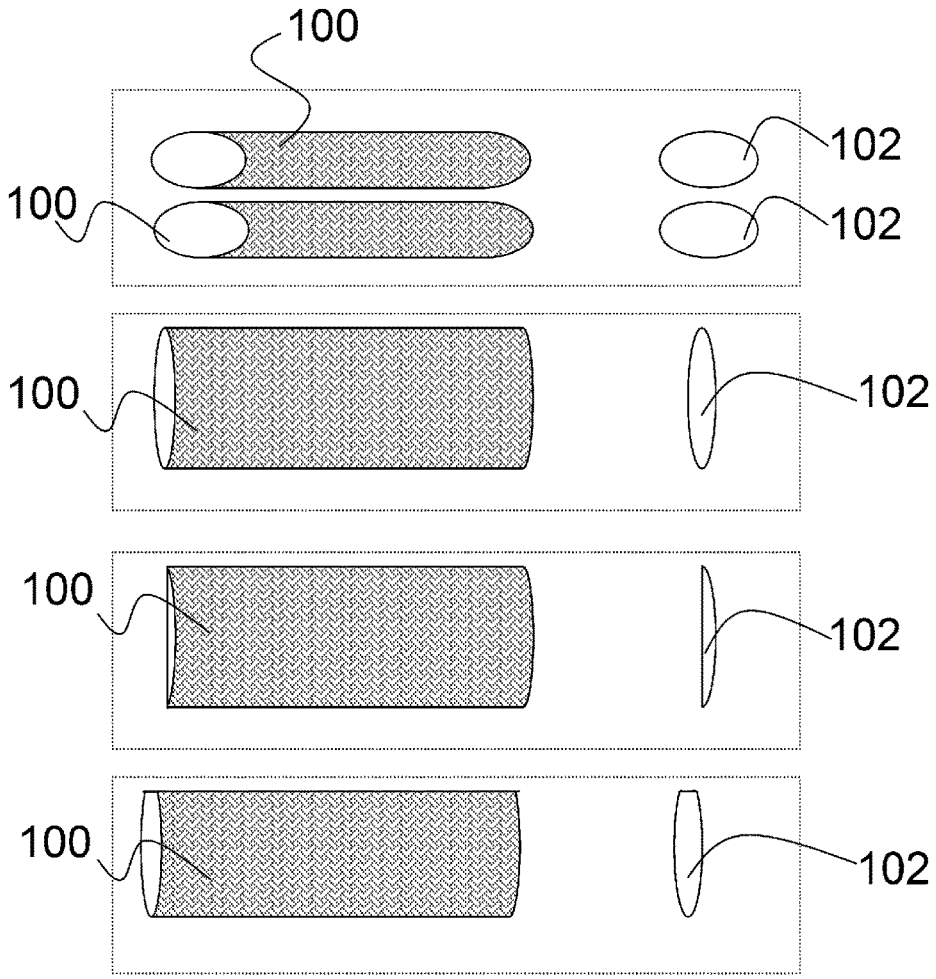
FIG. 8 illustrates several types of flat bars (100) with their corresponding cross-sections from preferred embodiments of the present invention.
Figure 9:
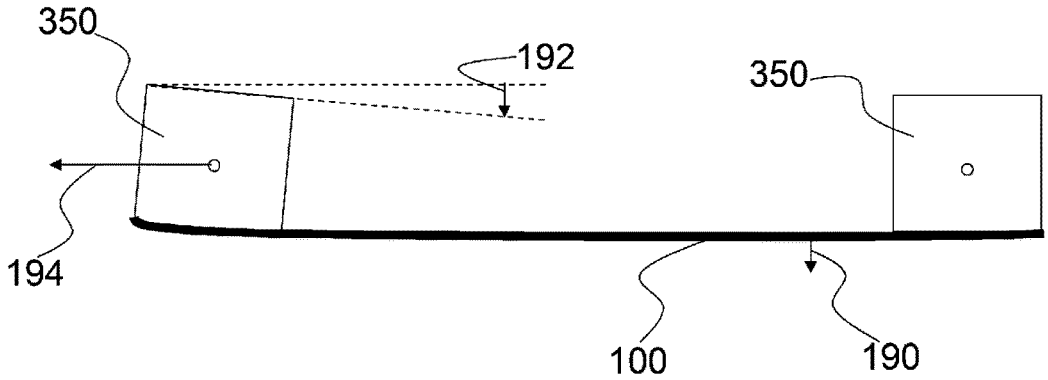
FIG. 9 illustrates the principle of the push down mechanism (190) of a preferred embodiment of the present invention in a cross-section illustration wherein a flat bar (100) is bended by rotating the left gantry and thus a flat portion of the flat bar (100) at its end with an angle (192) towards the transport system (not visible) and if needed by a displacement (194) of the gantry to the left, parallel to the print direction to build up the tension of the flat bar (100).
Figure 10:
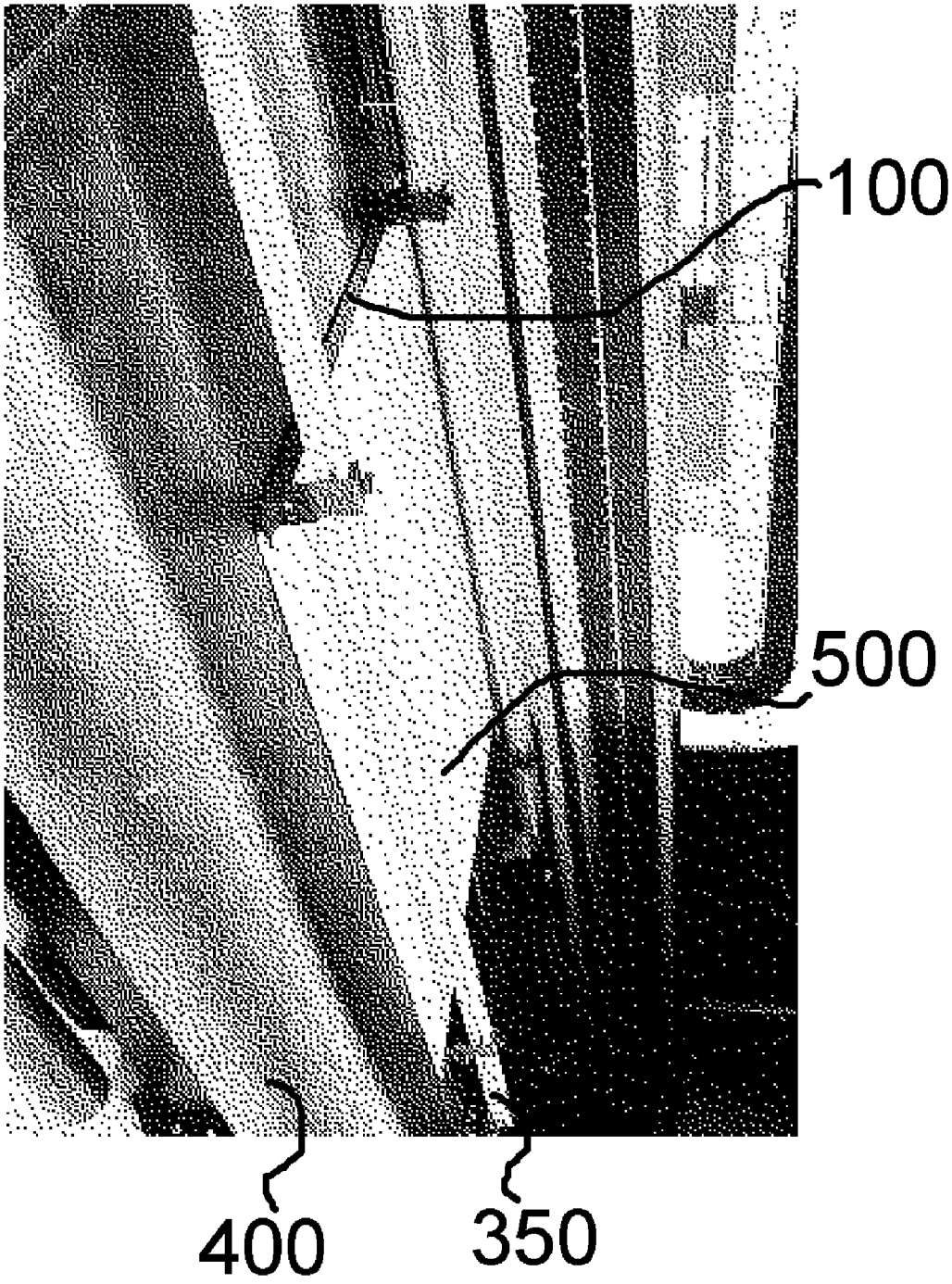
FIG. 10 is an image of working push-down mechanism with the push down mechanism as illustrated in FIG. 3, FIG. 4, FIG. 5, FIG. 6 and FIG. 7 and wherein the transport system (400) is a vacuum belt.

A preferred embodiment of the present invention is an inkjet printing device (300) comprising:

- a transport system for transporting a rigid multilayered substrate (500) in a print direction and support plane; and
- a dryer (315), attached to a first gantry which is positioned over the transport system and perpendicular to the print direction, for immobilizing a jetted ink layer on the rigid multilayered substrate (500) in a drying zone; and
- a push down mechanism for the rigid multilayered substrate (500) against the transport system, arranged at least in the drying zone;

wherein the push down mechanism comprises a flat bar (100) which is positioned parallel and elongated to the print direction and preferably mounted parallel to the support plane above the transport system; and wherein the flat bar (100) is maintained on a second and third gantry by a maintainer (355) on each gantry; and wherein the second and third gantry are positioned over the transport system at each side of the first gantry and perpendicular to the print direction; and wherein the push down mechanism, preferably the second and/or third gantry and more preferably at least one of the maintainers (355), comprises a bender for pushing a flat portion from the flat bar (100) at the push down side with an angle towards the transport system in a plane, perpendicular to the support plane and parallel to the print direction. The pushing of the flat portion with angle ensures that the flat bar (100) is pressed down between the second and third gantry and substantially in the middle to push down the rigid multilayered substrate (500) down in the drying zone so sudden curving is prevented and no damaging can occur. The maintainers (355); second and third gantry are part of the push down mechanism.

The present invention ensures the push down of the rigid multilayered substrate (500) over the width of the flat bar (100) in the drying zone.

And an inkjet printing method comprising the steps:

transporting on a transport system a rigid multilayered substrate (500) in a print direction and support plane; and immobilizing a jetted ink layer on the rigid multilayered substrate (500) in a drying zone by a dryer (315), attached to a first gantry which is positioned over the transport system and perpendicular to the print direction; and pushing down the rigid multilayered substrate (500) against the transport system in the drying zone by an flat bar (100) which is positioned parallel and elongated to the print direction and preferably mounted parallel to the support plane above the transport system; and maintaining the flat bar (100) on a second and third gantry wherein the second and third gantry are positioned over the transport system at each side of the first gantry and perpendicular to the print direction; and bending the flat bar (100) by pushing a flat portion from the flat bar (100) at the push down side with an angle towards the transport system in a plane, perpendicular to the support plane and parallel to the print direction.

In a preferred embodiment the inkjet printing method comprises the step after bending: displacing the maintainer (350) of the flat bar (100) on the second gantry in a direction parallel to the printing direction and parallel to the support plane away from the maintainer (350) of the flat bar (100) on the third gantry and/or displacing the maintainer of the flat bar (100) on the third gantry in a direction parallel to the printing direction and parallel to the support plane away from the maintainer (350) of the flat bar (100) on the second gantry. This displacement is advantageous to improve the tension of the flat bar after bending the step. The displacement (350) may be performed by displacing the second or third gantry, whereon the maintainer (350) is attached, away from the other gantry.

The inkjet printing method is preferably a single pass inkjet printing method.

The transport system is preferably a vacuum transport system wherein the rigid multilayered substrates (500) are hold down against the support surface of the vacuum transport system by vacuum power, produced in a vacuum chamber, attached to the transport system. More preferably the vacuum transport system is a movable vacuum printing table and most preferably the vacuum transport system is a vacuum belt. To transport large rigid multilayered substrates (500) under a print head, attached to the inkjet printing device (300), for printing ink layers on the rigid multilayered substrates (500), vacuum transport systems are beneficial to handle such kind of substrates. Especially a vacuum belt may handle more than only rigid substrates but also flexible substrates, such as textiles and plastic foils so the vacuum belt makes the inkjet printing device (300) a 'multi-substrate' inkjet printing device, an inkjet printing device (300) that can print on a plurality of substrates, even they are rigid or flat.

The dryer (315) comprises preferably a radiation source and more preferably a ultra-violet (UV) source such as an UV bulb lamp and/or an array of UV LED's. The radiation source may also be an infra-red (IR) source such as a Near Infra Red (NIR) source, Short Wave Infra Red (SWIR) source or an IR source with carbon infrared emitters. The kind of dryer (315) is determined by the chemistry of the inks that jetting the ink layers on the substrate. If an UV curable ink is used in the inkjet printing device (300) than an UV source is preferred as dryer (315). The first gantry whereon the dryer (315) is attached is stationary in the present invention. In a preferred embodiment the first gantry comprises also a plurality of print heads or a print head assembly with one or more print heads which jets a liquid, as droplets or vaporized liquid, on the rigid multilayered substrate (500).

The dryer (315) and if a print head is attached to the gantry may move back-and-forth along the first gantry as in a multi-pass inkjet printing device (300) or may be stationary attached for jetting and drying an ink layer on the rigid multilayered substrate (500).

The flat bar (100) is an elongated piece of metal of simple uniform cross-section shape such as circular, elliptical or hexagonal. This cross-section shape is preferably rectangular and more preferably rectangular with rounded corners to have less impressions of the flat bar (100) in the rigid multilayered substrate (500). It is found that sharp edges should be avoided to get no impressions of the flat bar (100) in the substrate. The flat bar (100) has to be rigid so it preferably comprises steel, stainless steel, aluminium, copper and/or carbon steel. The flat bar (100) is removable if not needed such as printing on flexible substrates and adaptable for different dimensions of rigid multilayered substrates (500) which makes the inkjet printing device (300) of the present invention a 'multi-substrate' inkjet printing device (300). The flat bar (100) has a guidance effect to guide the rigid multilayered substrate (500) underneath the dryer (315) and with the hold-down mechanism a prevention effect to prevent sudden warping up of the rigid multilayered substrate (500) damages against the dryer (315).

Preferably the flat bar (100) has a thickness, which is the distance measured perpendicular the support plane, between 0.5 mm and 5 mm so the distance of the dryer (315) versus the substrate can remains very small.

The length of the flat bar (100), which is the distance measured parallel to the print direction, preferably between 0.5 m and 2.0 m and more preferably between 0.7 m and 1.2 m.

The width of the flat bar (100), which is the distance measured perpendicular to the print direction is preferably 15 mm and 70 mm, more preferably between 30 mm and 60 mm. Larger the width, less the amount of printable surface of the rigid multilayered substrate (500).

The flat bar (100) may comprise at the entrance of the rigid multilayered substrate (500) an upraised flat portion to facilitate the entrance underneath the flat bar (100) by guiding, in a preferable funnel-shaped manner; the rigid multilayered substrate (500) comes closer to the substrate contact side of the flat bar (100). The upraised flat portion is preferably a funnel-shaped portion.

The flat portion of the flat bar (100) that is pushed with an angle preferably is positioned at the end of the flat bar (100)

and more preferably has a length larger than its width and most preferably has the same width as the flat bar (100). These characteristics of the flat portion of these preferred embodiments ensure the force of the push down mechanism. The angling with pushed force makes it possible to apply a stiffer flat bar (100) in the push down mechanism so the force of the push down mechanism is enhanced.

In a preferred embodiment the inkjet printing device (300) may comprise more than one push down mechanism for pushing down in several positions on the rigid multilayered substrate (500) for example the edges, from mostly rectangular shaped rigid multilayered substrate (500), wherein the edges are parallel to the printing direction.

In a preferred embodiment the flat bar (100) comprises a plurality of raised marks at the side which is in contact with the rigid multilayered substrate (500), also called the substrate contact side. The opposite side from the substrate contact side is called the push down side. The raised marks guarantee a higher hold-down of the rigid multilayered substrate (500) by the holding-down mechanism. The raised marks forms preferably a textured surface with reduced friction so more preferably the raised marks are elongated in the print direction so the gliding of the rigid multilayered substrate (500) underneath the flat bar (100) is improved. The flat bar (100) is preferably a diamond plate, such as the Rigidized Metals 5WL® from Rigidized Metals Corporation® with its woven fabrik look, wherein the raised marks are elongated in the print direction.

The flat bar (100) is preferably black at the push down side to prevent that radiation on the flat bar (100) is scattered to the print heads which may drying the ink in and on the print heads. The blackening of the push down side of the flat bar (100) is preferably done by coating it with a black liquid.

The push down mechanism, preferably the second and third gantry, more preferably the maintainer (355) comprises in a preferred embodiment: a height adjuster for positioning the flat bar (100) in a perpendicular direction of the support plane and/or a tensioner for tensioning the flat bar (100). And in other preferred embodiment the second gantry and third gantry both comprises a motion system to move the maintainer (355) perpendicular the print direction and parallel to the support plane. To have an optimal holding-down mechanism the flat bar (100) is provided at the two ends of the flat bar (100). A height adjuster is adjusted according the thickness of the rigid multilayered substrate (500). The height adjuster and tensioner are preferably present at the second and third gantry so parallel the flat bar (100) can be controlled.

The height adjuster and/or tensioner and/or motion system may be driven by a motor to have accurate and auto adjusting means for the flat panel and push down mechanism.

In a preferred embodiment the rigid multilayered substrate (500) is corrugated fibreboard. An in another preferred embodiment the rigid multilayered substrate (500) is a corrugated plastic. The present invention comprises also an embodiment of using one of the preferred embodiments of the inkjet printing device (300) for inkjet printing corrugated fibreboard. A rigid multilayered substrate (500) is in the present invention a flat substrate and preferably rectangular shaped.

In another preferred embodiment the rigid multilayered substrate (500) may heated or cooled at the back-side of the multilayered substrate to pre-conditioning the rigid media substrate before printing. The back-side of the multilayered substrate is the side that is in contact with the transport system. The opposite side from the back-side is the print-side whereon an ink-layer is jetted by the inkjet printing device (300).

In another preferred embodiment the rigid media substrate may be moisturized at the back-side and/or print-side for the multilayered substrate to pre-conditioning the rigid multilayered substrate (500) before printing. The moisturizing of the back-side and/or print-side is preferably on corrugated fibre boards.

To optimize the total printable area of the supported rigid multilayered substrate (500) the flat bars (100) are positioned over the edges of the supported rigid multilayered substrate (500). The edges of such rigid multilayered substrate (500) make it easy to align these substrates on the transport system to transfer straight the substrate trough the inkjet printing device (300). But in the present invention the edges lacks visibility due to the flat bars (100) on top of the substrate so in a preferred embodiment the flat bar (100) comprises a set of alignment holes (105), as aid, for aligning the rigid multilayered substrate (500) on the transport system. Through the set of alignment holes (105) the edge of the rigid multilayered substrate (500) is visible so the alignment is made easier. The diameters of the set of alignment holes (105) are preferably between 1 mm and 15 mm. A hole in the set of alignment holes (105) is preferably circular, triangular elliptical, square, rectangular shaped and/or a slit which is more preferably oriented along the printing direction. The area of the alignment holes (105) and positions on the flat bar (100) are determined so the stiffness of the flat bar (100), especially above the drying zone, remains.

Preferably the number of holes is more than two and more preferably distributed on a virtual line perpendicular to the printing direction and most preferably drilled at the second gantry and the third gantry. Too many holes should be avoided else the stiffness of the flat bar (100) is affected. The maximum number of holes is preferably less than 15 at the second gantry and the third gantry.

In a preferred embodiment two rigid multilayered substrates (500) are supported on the transport system, preferably a vacuum belt and positioned next to each other along the width of the inkjet printing device (300). The push down mechanism in this preferred embodiment comprises three flat bars (100): one for pushing down the left edge of the left rigid multilayered substrate (500); one for pushing down the right edge of the right rigid multilayered substrate (500) and one for pushing down together the other edges from the rigid multilayered substrates (500).

In a preferred embodiment the second gantry and/or third gantry comprises a ruler for determination visual the position of the flat bar and its maintainer so user-friendliness is enhanced.

Inkjet Printing Device (300)

An inkjet printing device (300), such as an inkjet printer, is a marking device that is using a print head or a print head assembly with one or more print heads which jets a liquid, as droplets or vaporized liquid, on a substrate. A marking that is marked by jetting of the inkjet printing device (300) on a substrate is preferably an image. The pattern may be achromatic or chromatic colour.

A preferred embodiment of the inkjet printing device (300) is that the inkjet printing device (300) is an inkjet printer and more preferably a wide-format inkjet printer. Wide-format inkjet printers are generally accepted to be any inkjet printer with a print width over 17 inches. Inkjet printers with a print width over the 100 inches are generally called super-wide printers or grand format printers. Wide-format printers are mostly used to print banners, posters, textiles and general signage and in some cases may be more economical than short-run methods such as screen printing. Wide format printers generally use a roll of substrate rather than individual sheets of substrate but today also wide format printers exist with a printing table whereon substrate is loaded.

In the present invention the inkjet printing device (300) may comprise a printing table, which may be vacuum table which moves under a print head. These so called flat-table digital printers most often are used for the printing of planar substrates, ridged substrates and sheets of flexible substrates. They may incorporate IR-dryers or UV-dryers to prevent prints from sticking to each other as they are produced. But preferably it comprises a conveyor belt; which may be a vacuum belt which transports a supported substrate under a print head.

The inkjet printing device (300) may perform a single pass printing method. In a single pass printing method the inkjet print heads remain stationary and the substrate is transported once under the one or more inkjet print heads. In a single pass printing method the method may be performed by using page wide inkjet print heads or multiple staggered inkjet print heads which cover the entire width of the substrate.

The inkjet printing device (300) may mark a broad range of substrates such as folding carton, acrylic plates, honeycomb board, corrugated board, foam, medium density fibreboard, solid board, rigid paper board, fluted core board, plastics, aluminium composite material, foam board, corrugated plastic, wood, carpet, textile, thin aluminium, paper, rubber, adhesives, vinyl, veneer, varnish blankets, wood, flexographic plates, metal based plates, fibreglass, plastic foils, glass sheet, mirrors, transparency foils, adhesive PVC sheets, impregnated paper and others. A substrate may comprise an inkjet acceptance layer.

Corrugated fibreboard, which is a rigid multilayered substrate (500), is a paper-based material consisting of a fluted corrugated sheet and one or two flat linerboards. It is made on "flute lamination machines" or "corrugators" and is mainly used in the manufacture of shipping containers and corrugated boxes. More information is disclosed in "The Packaging Designer's Book of Patterns", 4th edition, Laszlo Roth, John Wiley & Sons, 2012 especially Chapter 4: "Corrugated Containers"; ISBN: 978-1-118-13415-3.

In a preferred embodiment the rigid multilayered substrate (500) is a large substrate with a dimension between 1 $m^2$ and 50 $m^2$, more preferably between 2 $m^2$ and 25 $m^2$. The thickness of the rigid multilayered substrate (500) is preferably between 1 mm and 50 mm, more preferably between 3 mm and 25 mm.

The rigid multilayered substrate (500) is a flat substrate which means that the to-be-printed surface approximate a mathematical plane.

For drying the marked substrate an inkjet printing device (300) may comprises a dryer (315) to immobilize the jetted ink on the substrate. The dryer (315) preferably comprises an IR source and/or an UV source.

Preferably the inkjet printing device (300) comprises one or more print heads jetting UV curable ink to mark substrate and a UV source (=Ultra Violet source), as dryer (315), to cure the inks after marking. Spreading of a UV curable inkjet ink on a substrate may be controlled by a partial curing or "pin curing" treatment wherein the ink droplet is "pinned", i.e. immobilized where after no further spreading occurs. For example, WO 2004/002746 (INCA) discloses an inkjet printing method of printing an area of a substrate in a plurality of passes using curable ink, the method comprising depositing a first pass of ink on the area; partially curing ink deposited in the first pass; depositing a second pass of ink on the area; and fully curing the ink on the area.

A preferred configuration of UV source is a mercury vapour lamp. Within a quartz glass tube containing e.g. charged mercury, energy is added, and the mercury is vaporized and ionized. As a result of the vaporization and ionization, the high-energy free-for-all of mercury atoms, ions, and free electrons results in excited states of many of the mercury atoms and ions. As they settle back down to their ground state, radiation is emitted. By controlling the pressure that exists in the lamp, the wavelength of the radiation that is emitted can be somewhat accurately controlled, the goal being of course to ensure that much of the radiation that is emitted falls in the ultraviolet portion of the spectrum, and at wavelengths that will be effective for UV curable ink curing. Another preferred UV source is an UV-Light Emitting Diode, also called an UV-LED.

The inkjet printing device (300) may comprise an IR source (=Infra Red source) to solidify the ink by infra-red radiation. The IR source is preferably a NIR source (=Near Infra Red source) such as a NIR lamp. The IR source may comprise carbon infrared emitters which has a very short response time. An other IR source is a SWIR (=Short Wave Infra Red source).

The IR source or UV source in the above preferred embodiments create a drying zone on the transport system, such as a vacuum belt, to immobilize jetted ink on the substrate.

The inkjet printing device (300) may comprise corona discharge equipment to treating the substrate before the substrate passes a print head of the inkjet printing device (300) because some substrates have chemically inert and/or nonporous top-surfaces leading to a low surface energy which may result in bad print quality. The embodiment of the printing method is preferably comprised in an industrial inkjet printing method such as a corrugated fibre board inkjet printing method.

Corona Discharge Equipment

Corona discharge equipment consists of a high-frequency power generator, a high-voltage transformer, a stationary electrode, and a treater ground roll. Standard utility electrical power is converted into higher frequency power which is then supplied to the treater station. The treater station applies this power through ceramic or metal electrodes over an air gap onto the material's surface.

A corona treatment can be applied in the present invention to unprimed substrates, but also to primed substrates.

Vacuum Chamber

A vacuum chamber is a rigid enclosure which is constructed by many materials preferably it may comprise a metal. The choice of the material is based on the strength, pressure and the permeability. The material of the vacuum chamber may comprise stainless steel, aluminium, mild steel, brass, high density ceramic, glass or acrylic.

A vacuum pump provides a vacuum pressure inside a vacuum chamber and is connected by a vacuum pump connector, such as a tube, to a vacuum pump input such as aperture in the vacuum chamber. Between the vacuum pump connector a vacuum controller, such as a valve or a tap, may be provided to control the vacuum in a sub-vacuum chamber wherein the aperture is positioned.

To prevent contamination, such as paper dust, substrate fibers, ink, ink residues and/or ink debris such as cured ink, to contaminate via the set of air-channels of the vacuum support and/or the set of vacuum-belt-air-channels from the vacuum support the interior means of the vacuum pump, a filter, such as an air filter and/or coalescence filter, may be connected to the vacuum pump connector. Preferably a coalescence filter, as filter, is connected to the vacuum pump connector to split liquid and air from the contamination in the vacuum pump connector.

Vacuum Table

A vacuum table is a vacuum transport system. A vacuum chamber comprised in an inkjet printing device (300), hold-downs the substrate for fixing the substrate against the vacuum table.

To avoid registration problems while printing on a substrate and to avoid collisions while conveying a substrate, the substrate needs to be connected to a support, also called a printing table. A vacuum table is a printing table wherein the substrate is connected to the printing table by vacuum pressure. A vacuum table is also called a porous printing table. Between the substrate and the vacuum table may be a vacuum belt sandwiched when a vacuum belt is wrapped around the vacuum table.

A vacuum table comprises a base unit. The base unit is preferably stable and robust. It comprises fixing means suitable for attaching to an inkjet printing device (300). To have a strong, stable and robust base unit, the base unit comprises preferably metal such as steel or aluminium. The support layer may have any shape but is preferably rectangular shaped. The size of the support layer from the flatbed table is preferably from 1 $m^2$ until 60.0 $m^2$, more preferably from 2.0 until 50.0 $m^2$ and most preferably from 3.00 until 30.0 $m^2$. The larger the size of the support layer, the larger a substrate can be supported which results in a production boost. The width or height of the flatbed table is preferably from 1.0 m until 10 m. The larger the width and/or height, the larger the substrate may be supported by the flatbed table which is an economical benefit.

Preferably the vacuum table in the embodiment comprises a set of air-channels to provide a pressure differential by a vacuum chamber at the support layer of the vacuum table to create a vacuum zone and at the bottom-surface of the printing table a set of apertures which are connected to the set of air-channels. These apertures at the bottom layer may be circular, elliptical, square, rectangular shaped and/or grooves, such as slits, parallel with the bottom layer of the vacuum table.

The width or height of the vacuum table is preferably from 1.0 m until 10 m. The larger the width and/or height, the larger the substrate may be supported by the vacuum table which is an economical benefit.

An aperture at the bottom-surface and at the support surface of the vacuum table may be connected to one or more air-channels. An aperture at the bottom-surface or support surface of the vacuum table may be small in size, preferably from 0.3 to 12 mm in diameter, more preferably from 0.4 to 8 mm in diameter, most preferably from 0.5 to 5 mm in diameter and preferably spaced evenly apart on the vacuum support preferably 1 mm to 50 mm apart, more preferably from 4 to 30 mm apart and most preferably from 5 to 15 mm apart to enable the creation of uniform vacuum pressure that connects a substrate together with the vacuum table.

A set of apertures at the support layer of the vacuum table may be connected to the air-channels. These apertures at the support layer may be circular, elliptical, square, rectangular shaped and/or grooves, such as slits, parallel with the support layer of the vacuum table. Preferably, if the apertures are grooves, the grooves are oriented along the printing direction of the inkjet printing device (300).

Preferably the vacuum table of the embodiment comprising a honeycomb structure plate which is sandwiched between a top and bottom sandwich plate which comprises each a set of apertures connect to one or more air-channels in the vacuum table. The honeycomb cores, as part of the air-channels, in the honeycomb structure plate results in a better uniform vacuum distribution on the support surface of the vacuum table.

The dimensions and the amount of air-channels should be sized and frequently positioned to provide sufficient vacuum pressure to the vacuum table. Also the dimensions and the amount of apertures at the bottom-surface of the vacuum table should be sized and frequently positioned to provide sufficient vacuum pressure to the vacuum table. The dimension between two air-channels or two apertures at the bottom-surface of the vacuum table may be different. A honeycomb core is preferably sinusoidal or hexagonal shaped.

If a honeycomb structure plate is comprised in the vacuum table also the dimensions and the amount of honeycomb cores should be sized and frequently positioned to provide sufficient vacuum pressure to the vacuum table. The dimensions between two neighbour honeycomb cores may be different.

The support layer of the printing table should be constructed to prevent damaging of a substrate or vacuum support if applicable. For example the apertures at the support layer that are connected with the air-channels may have rounded edges. The support layer of the printing table may be configured to have low frictional specifications.

The vacuum table is preferably parallel to the ground whereon the inkjet printing system is connected to avoid misaligned printed images.

The vacuum pressure in a vacuum zone on the support surface of the vacuum table may couple the substrate and the vacuum table (100) by sandwiching the vacuum belt that carries the substrate. The coupling is preferably done while printing to hold down the substrate to avoid bad alignment and color-on-color register problems. The vacuum pressure in a vacuum zone on the support surface of the vacuum table may apply sufficient normal force to the vacuum support when the vacuum support is moving and carrying a substrate in the conveying direction. The vacuum pressure may also prevent any fluttering and/or vibrating of the vacuum support or substrate on the vacuum support. The vacuum pressure in a vacuum zone may be adapted while printing.

The top-surface, also called the support surface, of the vacuum table or a portion of the vacuum table, such as the inner side of its air-channels may be coated to have easy cleaning performances e.g. as result of dust or ink leaks. The coating is preferably a dust repellent and/or ink repellent and/or hydrophobic coating. Preferably the top-surface of the vacuum table or a portion of the vacuum table, such as the inner side of its air-channels, is treated with an ink repelling hydrophobic method by creating a lubricious and repelling surface which reduces friction.

Vacuum-Support-Air-Channel

A vacuum-support-air-channel is an air-channel from the support surface to the bottom surface of the vacuum support. It is also called a suction-hole if the perimeter of the vacuum-support-air-channel at the support surface is substantially circular.

The area of a vacuum-support-air-channel at the support surface of the vacuum support is in the present invention preferably between 0.3 $mm^2$ and 5 $mm^2$. More preferably the perimeter of the vacuum-support-air-channel at the support surface has the same shape as a circle, ellipse, oval, rectangle, triangle, square, rectangle, pentagon, hexagon, heptagon, octagon or any polygon containing at least three sides.

The vacuum-support-air-channel is preferably tapered in the direction of the bottom surface for optimal vacuum pressure effect at the support surface.

The distribution of air-channels on the support surface of the vacuum support is preferably between 1 air-channel per dm2 and 100 air-channels per $dm^2$; more preferably between 5 air-channels per $dm^2$ and 50 per $dm^2$.

The perimeter of a suction-hole is preferably from 0.3 to 10 mm in diameter, more preferably from 0.4 to 5 mm in diameter, most preferably from 0.5 to 2 mm in diameter The vacuum-belt-air-channels in the air-sucking zone are preferably spaced evenly apart on the vacuum support preferably 3 mm to 50 mm apart, more preferably from 4 to 30 mm apart and most preferably from 5 to 15 mm apart to enable the creation of uniform vacuum pressure that holds the substrate together with the vacuum support. Smaller the apertures in the vacuum support, higher the vacuum pressure at the top of the vacuum support.

Vacuum Belt

A vacuum belt is a vacuum transport system. A vacuum belt, comprised in an inkjet printing device (300), transports a substrate for printing and hold-downs the substrate for fixing the substrate against the vacuum belt.

Preferably the vacuum belt has two or more layers of materials wherein an under layer provides linear strength and shape, also called the carcass and an upper layer called the cover or the support side. The carcass is preferably a woven fabric web and more preferably a woven fabric web of polyester, nylon, glass fabric or cotton. The material of the cover is preferably various rubber and more preferably plastic compounds and most preferably thermoplastic polymer resins. But also other exotic materials for the cover can be used such as silicone or gum rubber when traction is essential. An example of a multilayered conveyor belt for a general belt conveyor system wherein the cover having a gel coating is disclosed in US 20090098385 A1 (FORBO SIEBLING GMBH).

Preferably the vacuum belt comprises glass fabric or the carcass is glass fabric and more preferably the glass fabric, as carcass, has a coated layer on top comprising a thermoplastic polymer resin and most preferably the glass fabric has a coated layer on top comprising polyethylene terephthalate (PET), polyamide (PA), high-density polyethylene (HDPE), polytetrafluoroethylene (PTFE), polyoxymethylene (POM), polyurethaan (PU) and/or Polyaryletherketone (PAEK). The coated layer may also comprise aliphatic polyamides, polyamide 11 (PA 11), polyamide 12 (PA 12), UHM-HDPE, HM-HDPE, Polypropylene (PP), Polyvinyl chloride (PVC), Polysulfone (PS), Poly(p-phenylene oxide) (PPO™), Polybutylene terephthalate (PBT), Polycarbonate (PC), Polyphenylene sulphide (PPS).

Preferably the vacuum belt is and endless vacuum belt. Examples and figures for manufacturing an endless multilayered vacuum belt for a general belt conveyor system are disclosed in EP 1669635 B (FORBO SIEBLING GMBH).

The top-surface of the vacuum belt or a portion of the vacuum belt, such as its air-channels, may be coated to have easy cleaning as result of e.g. dust or ink leaks. The coating is preferably a dust repellent and/or ink repellent and/or hydrophobic coating. Preferably the top-surface of the vacuum belt or a portion of the vacuum, belt is treated with an ink repelling hydrophobic method by creating a lubricious and repelling surface which reduces friction.

A layer of neutral fibres in the vacuum belt is preferably constructed at a distance from the bottom surface between 2 mm and 0.1 mm, more preferably between 1 mm and 0.3 mm. This layer with neutral fibres is of big importance to have a straight conveying direction with minimal side force on the vacuum belt and/or minimized fluctuation of the Pitch Line of the vacuum belt for high printing precision transportation.

The top surface, also called the support surface, of the vacuum belt comprises preferable hard urethane with a preferred thickness (measured from top surface to bottom surface) between 0.2 to 5.5 mm. The total thickness (measured from top surface to bottom surface) of the vacuum belt is preferably between 1.2 to 7 mm. The top-surface is preferably high resistance to solvents so the inkjet printing device (300) is useful in an industrial printing and/or manufacturing environment.

Print Head

A print head is a means for jetting a liquid on a substrate through a nozzle. The nozzle may be comprised in a nozzle plate which is attached to the print head. A print head preferably has a plurality of nozzles which may be comprised in a nozzle plate. A set of liquid channels, comprised in the print head, corresponds to a nozzle of the print head which means that the liquid in the set of liquid channels can leave the corresponding nozzle in the jetting method. The liquid is preferably an ink, more preferably an UV curable inkjet ink or water based inkjet ink, such as a water based resin inkjet ink. The liquid used to jet by a print head is also called a jettable liquid. A high viscosity jetting method with UV curable inkjet ink is called a high viscosity UV curable jetting method. A high viscosity jetting method with water based inkjet ink is called a high viscosity water base jetting method.

The way to incorporate print heads into an inkjet printing device (300) is well-known to the skilled person.

A print head may be any type of print head such as a Valvejet print head, piezoelectric print head, thermal print head, a continuous print head type, electrostatic drop on demand print head type or acoustic drop on demand print head type or a page-wide print head array, also called a page-wide inkjet array.

A print head comprises a set of master inlets to provide the print head with a liquid from a set of external liquid feeding units. Preferably the print head comprises a set of master outlets to perform a recirculation of the liquid through the print head. The recirculation may be done before the droplet forming means but it is more preferred that the recirculation is done in the print head itself, so called through-flow print heads. The continuous flow of the liquid in a through-flow print heads removes air bubbles and agglomerated particles from the liquid channels of the print head, thereby avoiding blocked nozzles that prevent jetting of the liquid. The continuous flow prevents sedimentation and ensures a consistent jetting temperature and jetting viscosity. It also facilitates auto-recovery of blocked nozzles which minimizes liquid and receiver wastage.

The number of master inlets in the set of master inlets is preferably from 1 to 12 master inlets, more preferably from 1 to 6 master inlets and most preferably from 1 to 4 master inlets. The set of liquid channels that corresponds to the nozzle are replenished via one or more master inlets of the set of master inlets.

The amount of master outlets in the set of master outlets in a through-flow print head is preferably from 1 to 12 master outlets, more preferably from 1 to 6 master outlets and most preferably from 1 to 4 master outlets.

In a preferred embodiment prior to the replenishing of a set of liquid channels, a set of liquids is mixed to a jettable liquid that replenishes the set of liquid channels. The mixing to a jettable liquid is preferably performed by a mixing means, also called a mixer, preferably comprised in the print head wherein the mixing means is attached to the set of master inlets and the set of liquid channels. The mixing means may comprise a stirring device in a liquid container, such as a manifold in the print head, wherein the set of liquids are mixed by a mixer. The mixing to a jettable liquid also means the dilution of liquids to a jettable liquid. The late mixing of a set of liquids for jettable liquid has the benefit that sedimentation can be avoided for jettable liquids of limited dispersion stability.

The liquid leaves the liquid channels by a droplet forming means, through the nozzle that corresponds to the liquid channels. The droplet forming means are comprised in the print head. The droplet forming means are activating the liquid channels to move the liquid out the print head through the nozzle that corresponds to the liquid channels.

The amount of liquid channels in the set of liquid channels that corresponds to a nozzle is preferably from 1 to 12, more preferably from 1 to 6 and most preferably from 1 to 4 liquid channels.

The print head of the present invention is preferably suitable for jetting a liquid having a jetting viscosity of 8 mPa·s to 3000 mPa·s. A preferred print head is suitable for jetting a liquid having a jetting viscosity of 20 mPa·s to 200 mPa·s; and more preferably suitable for jetting a liquid having a jetting viscosity of 50 mPa·s to 150 mPa·s.

Piezoelectric Print Heads

A preferred print head for the present invention is a piezoelectric print head. piezoelectric print head, also called piezoelectric inkjet print head, is based on the movement of a piezoelectric ceramic transducer, comprised in the print head, when a voltage is applied thereto. The application of a voltage changes the shape of the piezoelectric ceramic transducer to create a void in a liquid channel, which is then filled with liquid. When the voltage is again removed, the ceramic expands to its original shape, ejecting a droplet of liquid from the liquid channel.

The droplet forming means of a piezoelectric print head controls a set of piezoelectric ceramic transducers to apply a voltage to change the shape of a piezoelectric ceramic transducer. The droplet forming means may be a squeeze mode actuator, a bend mode actuator, a push mode actuator or a shear mode actuator or another type of piezoelectric actuator.

Suitable commercial piezoelectric print heads are TOSHIBA TECTN CK1 and CK1L from TOSHIBA TEC™ (https://www.toshibatec.co.jp/en/products/industrial/inkjet/prod ucts/cf1/) and XAAR™ 1002 from XAAR™ (http://www.xaar.com/en/products/xaar-1002).

A liquid channel in a piezoelectric print head is also called a pressure chamber.

Between a liquid channel and a master inlet of the piezoelectric print heads, there is a manifold connected to store the liquid to supply to the set of liquid channels.

The piezoelectric print head is preferably a through-flow piezoelectric print head. In a preferred embodiment the recirculation of the liquid in a through-flow piezoelectric print head flows between a set of liquid channels and the inlet of the nozzle wherein the set of liquid channels corresponds to the nozzle.

In a preferred embodiment in a piezoelectric print head the minimum drop size of one single jetted droplet is from 0.1 pL to 300 pL, in a more preferred embodiment the minimum drop size is from 1 pL to 30 pL, in a most preferred embodiment the minimum drop size is from 1.5 pL to 15 pL. By using grayscale inkjet head technology multiple single droplets may form larger drop sizes.

In a preferred embodiment the piezoelectric print head has a drop velocity from 3 meters per second to 15 meters per second, in a more preferred embodiment the drop velocity is from 5 meters per second to 10 meters per second, in a most preferred embodiment the drop velocity is from 6 meters per second to 8 meters per second.

In a preferred embodiment the piezoelectric print head has a native print resolution from 25 DPI to 2400 DPI, in a more preferred embodiment the piezoelectric print head has a native print resolution from 50 DPI to 2400 DPI and in a most preferred embodiment the piezoelectric print head has a native print resolution from 150 DPI to 3600 DPI.

In a preferred embodiment with the piezoelectric print head the jetting viscosity is from 8 mPa·s to 200 mPa·s more preferably from 25 mPa·s to 100 mPa·s and most preferably from 30 mPa·s to 70 mPa·s.

In a preferred embodiment with the piezoelectric print head the jetting temperature is from 10° C. to 100° C. more preferably from 20° C. to 60° C. and most preferably from 30° C. to 50° C.

The nozzle spacing distance of the nozzle row in a piezoelectric print head is preferably from 10 μm to 200 μm; more preferably from 10 μm to 85 μm; and most preferably from 10 μm to 45 μm.

Inkjet Ink

In a preferred embodiment, the liquid in the print head (305) is an aqueous curable inkjet ink, and in a most preferred embodiment the inkjet ink is an UV curable inkjet ink.

A preferred aqueous curable inkjet ink includes an aqueous medium and polymer nanoparticles charged with a polymerizable compound. The polymerizable compound is preferably selected from the group consisting of a monomer, an oligomer, a polymerizable photoinitiator, and a polymerizable co-initiator.

An inkjet ink may be a colourless inkjet ink and be used, for example, as a primer to improve adhesion or as a varnish to obtain the desired gloss. However, preferably the inkjet ink includes at least one colorant, more preferably a colour pigment. The inkjet ink may be a cyan, magenta, yellow, black, red, green, blue, orange or a spot color inkjet ink, preferable a corporate spot color inkjet ink such as red colour inkjet ink of Coca-Cola™ and the blue colour inkjet inks of VISA™ or KLM™. In a preferred embodiment the inkjet ink comprises metallic particles or comprising inorganic particles such as a white inkjet ink.

In a preferred embodiment an inkjet ink contains one or more pigments selected from the group consisting of carbon black, C.I. Pigment Blue 15:3, C.I. Pigment Blue 15:4, C.I Pigment Yellow 150, C.I Pigment Yellow 151, C.I. Pigment Yellow 180, C.I. Pigment Yellow 74, C.I Pigment Red 254, C.I. Pigment Red 176, C.I. Pigment Red 122, and mixed crystals thereof.

Jetting Viscosity and Jetting Temperature

The jetting viscosity is measured by measuring the viscosity of the liquid at the jetting temperature.

The jetting viscosity may be measured with various types of viscometers such as a Brookfield DV-II+ viscometer at jetting temperature and at 12 rotations per minute (RPM) using a CPE 40 spindle which corresponds to a shear rate of 90 s−1 or with the HAAKE Rotovisco 1 Rheometer with sensor C60/1 Ti at a shear rate of 1000s−1

In a preferred embodiment the jetting viscosity is from 10 mPa·s to 200 mPa·s more preferably from 25 mPa·s to 100 mPa·s and most preferably from 30 mPa·s to 70 mPa·s.

The jetting temperature may be measured with various types of thermometers.

The jetting temperature of jetted liquid is measured at the exit of a nozzle in the print head (305) while jetting or it may be measured by measuring the temperature of the liquid in the liquid channels or nozzle while jetting through the nozzle.

In a preferred embodiment the jetting temperature is from 10° C. to 100° C. more preferably from 20° C. to 60° C. and most preferably from 30° C. to 50° C.

REFERENCE SIGNS LIST

| | | | |
|---|---|---|---|
| 100 | Flat bar | 300 | Inkjet printing device |
| 350 | Gantry | 300 | dryer |
| 355 | Maintainer | 500 | Rigid multilayered substrate |
| 405 | Print direction | 400 | Transport system |
| 194 | Displacement | 105 | Set of alignment holes |
| 3552 | Attachable means | 3551 | Attachable means |
| 190 | Push down mechanism | 192 | Angle |

The invention claimed is:

1. An inkjet printing device comprising:

a transport that transports a multi-layered substrate in a print direction and in a support plane;

a dryer, attached to a first gantry that is stationary above the transport and extends perpendicular to the print direction, that immobilizes a jetted ink layer on the multi-layered substrate in a drying zone; and a pusher that pushes the multi-layered substrate against the transport in at least the drying zone; wherein the pusher includes a flat bar that is parallel to, and extends in, the print direction;

the flat bar is held on a second gantry and a third gantry by a maintainer on each of the second gantry and the third gantry;

the second gantry and third gantry are located above the transport at each side of the first gantry and extend perpendicular to the print direction; and the pusher includes a bender that pushes a flat portion of the flat bar downward toward the transport in a plane that is perpendicular to the support plane and parallel to the print direction.

2. The inkjet printing device according to claim 1, wherein a side of the flat bar that contacts the substrate includes raised marks which are elongated in the print direction.

3. The inkjet printing device according to claim 2, wherein the second gantry and third gantry each include a mover that moves the respective maintainer perpendicular to the print direction and parallel to the support plane.

4. The inkjet printing device according to claim 3, wherein the pusher includes a height adjuster that positions the flat bar in a direction perpendicular to the support plane and/or a tensioner that tensions the flat bar.

5. The inkjet printing device according to claim 4, wherein the flat bar includes a plurality of alignment holes to align the multi-layered substrate on the transport.

6. The inkjet printing device according to claim 1, wherein the transport includes a conveyor belt or a movable printing table.

7. The inkjet printing device according to claim 1, wherein the first gantry includes a plurality of print heads that jet ink.

8. The inkjet printing device according to claim 1, wherein the multilayer substrate is corrugated fibreboard or corrugated plastic.

9. An inkjet printing method comprising the steps of:

transporting on a transport a multi-layered substrate in a print direction and in a support plane;

immobilizing a jetted ink layer on the multi-layered substrate in a drying zone with a dryer attached to a first gantry that is positioned above the transport and extends perpendicular to the print direction;

pushing down the multi-layered substrate against the transport in the drying zone with a flat bar that is positioned parallel to, and extends in, the print direction;

holding the flat bar with a second gantry and a third gantry positioned above the transport at each side of the first gantry and perpendicular to the print direction; and bending the flat bar by pushing a flat portion of the flat bar downwards at an angle towards the transport in a plane that is perpendicular to the support plane and parallel to the print direction.

10. The inkjet printing method according to claim 9, wherein the immobilizing step includes radiating infrared radiation with an infrared dryer and/or UV radiation with an ultraviolet dryer.

11. The inkjet printing method according to claim 10, further comprising the step of:

heating or cooling a side of the multi-layered substrate that is in contact with the transport.

12. The inkjet printing method according to claim 10, wherein the inkjet printing method is a single-pass inkjet printing method.

13. The inkjet printing method according to claim 10, wherein the flat bar is made of a material that includes steel, stainless steel, aluminum, copper, and/or carbon steel.

14. The inkjet printing method according to claim 13, wherein the flat bar includes a diamond plate.

15. The inkjet printing method according to claim 9, wherein the multilayer substrate is corrugated fibreboard or corrugated plastic.

* * * * *